US010995962B2

(12) United States Patent
Schillizzi et al.

(10) Patent No.: US 10,995,962 B2
(45) Date of Patent: May 4, 2021

(54) DEVICE FOR COVERING A STOVE TOP

(71) Applicants: Patricia Schillizzi, Oro Valley, AZ (US); Shawn Schillizzi, Oro Valley, AZ (US)

(72) Inventors: Patricia Schillizzi, Oro Valley, AZ (US); Shawn Schillizzi, Oro Valley, AZ (US)

( * ) Notice: Subject to any disclaimer, the term of this patent is extended or adjusted under 35 U.S.C. 154(b) by 126 days.

(21) Appl. No.: 16/372,988

(22) Filed: Apr. 2, 2019

(65) Prior Publication Data

US 2019/0226685 A1 Jul. 25, 2019

Related U.S. Application Data

(60) Provisional application No. 62/651,977, filed on Apr. 3, 2018.

(51) Int. Cl.

| | |
|---|---|
| ***F24C 15/12*** | (2006.01) |
| ***A47B 13/08*** | (2006.01) |
| ***A47B 33/00*** | (2006.01) |

(52) U.S. Cl.

CPC ..... *F24C 15/12* (2013.01); *A47B 13/08* (2013.01); *A47B 33/00* (2013.01)

(58) Field of Classification Search

CPC ..... F24C 15/12; A47B 33/00
USPC ..... 126/221, 37 A
See application file for complete search history.

(56) References Cited

U.S. PATENT DOCUMENTS

| | | | | |
|---|---|---|---|---|
| 2,696,812 | A * | 12/1954 | Merritt, Jr. | F24C 15/12 126/214 R |
| 4,867,135 | A * | 9/1989 | Stecker | F24B 1/198 126/500 |
| 5,094,316 | A * | 3/1992 | Rosen | B60R 7/04 181/141 |
| 5,331,945 | A | 7/1994 | Somerton | |
| 5,793,021 | A | 8/1998 | Walton | |
| 6,044,834 | A * | 4/2000 | Zappetti | F24C 15/12 126/214 D |
| 6,263,869 | B1 | 7/2001 | Abernethy | |
| 6,399,924 | B1 * | 6/2002 | Cai | F24C 15/12 126/211 |
| 6,763,825 | B1 | 7/2004 | Geible | |
| 2009/0064990 | A1 * | 3/2009 | Wilkins | F24C 15/12 126/37 A |
| 2009/0301462 | A1 | 12/2009 | Churchill | |
| 2013/0081608 | A1 * | 4/2013 | Bonadio | F24C 15/12 126/221 |
| 2014/0096761 | A1 * | 4/2014 | Brantley | F24C 15/14 126/39 M |
| 2016/0305669 | A1 * | 10/2016 | Sanquist | A47G 23/06 |
| 2019/0003722 | A1 * | 1/2019 | Altan | F24C 15/12 |

* cited by examiner

*Primary Examiner* — Avinash A Savani
*Assistant Examiner* — Deepak A Deean
(74) *Attorney, Agent, or Firm* — Boudwin Intellectual Property; Daniel Boudwin

(57) ABSTRACT

A device for covering a stove top. The device for covering a stove top includes a frame. The frame has an upper side and a lower side. The frame is sized to rest on a stove top, covering burners of that stove top. A cover is attached on the upper side of the frame and forms an interior cavity. The interior cavity is accessible via the lower side of the frame. A handle is disposed on a lateral edge of the frame.

10 Claims, 2 Drawing Sheets

DEVICE FOR COVERING A STOVE TOP

CROSS REFERENCE TO RELATED APPLICATIONS

This application claims the benefit of U.S. Provisional Application No. 62/651,977 filed on Apr. 3, 2018. The above identified patent application is herein incorporated by reference in its entirety to provide continuity of disclosure.

BACKGROUND OF THE INVENTION

The present invention relates to a device for covering a stove top. More specifically, the present invention provides a stove top cover that is easily placeable over a desired area of a stove top burner.

Stove tops are an essential feature of nearly every kitchen. Stove tops typically provide burners upon which pots, pans, or other cooking utensils, may be placed in order to introduce heat in a cooking process. Commonly, these burners are elevated above the stove top surface. When the burners are elevated above the stove top surface, it can be inconvenient for an individual, as they are not able to use the space of the stove top surface for tasks that require a flat surface. Furthermore, the individual may desire to utilize a stove top surface for storage space when they are not using the stove top for cooking. In order to maximize the storage space provided by the stove top area, a flat surface is desirable.

Additionally, many stove top surfaces are made of materials, such as wood, steel or aluminum, that are prone to slippage when items are placed on them. Items placed onto these surfaces, such as for storage or even use, are more susceptible to tipping over for falling over. This can lead to damage in the case of glassware or ceramic cooking utensils. Additionally, sharp knives or other cutting materials can cause injuries to the individual if unwanted sliding is experienced. Additionally, if an individual is stirring a food product, such as a cake batter, in a bowl, the individual will desire a stable surface upon which to stir the bowl.

By freeing up space in a kitchen, an individual can provide themselves with a more relaxing space in which to cook, bake or otherwise prepare food. Additionally, by reducing the amount of non-usable space, the individual will increase the amount of functional work space. With an increased amount of functional work space, the individual will be able to prepare food more efficiently, thus allowing them to reduce mistakes, and if appropriate, to prepare more food at a faster rate.

SUMMARY OF THE INVENTION

In view of the foregoing disadvantages inherent in the known types of stove top covers now present in the prior art, the present invention provides a device for covering a stove top, wherein the same can be utilized for providing convenience for the user when rendering the space above a stove top burner into a function work space or an additional storage location.

The present system comprises a frame. The frame defines an upper side oppositely of a lower side. The frame is dimensioned to rest upon a targeted stove top. A cover is disposed over the upper side of the frame. The cover, being disposed over the frame, defines an interior cavity. The interior cavity is accessible via the lower side of the frame. A handle is disposed on a lateral edge of the frame.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
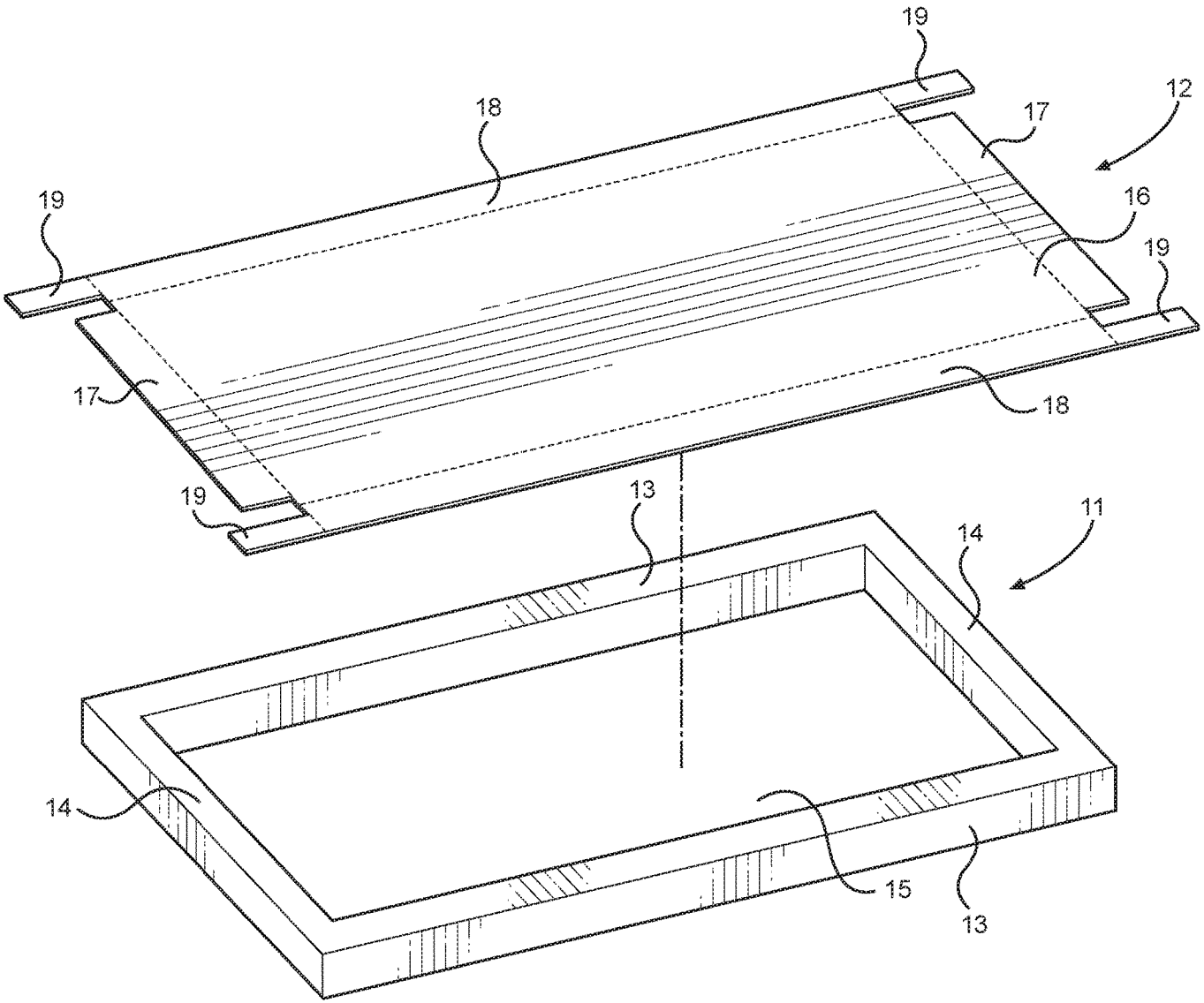
FIG. 1 shows an exploded view of an embodiment of the device for covering a stove top.

Reference is made herein to the attached drawings. Like reference numerals are used throughout the drawings to depict like or similar elements of the device for covering a stove top. The figures are intended for representative purposes only and should not be considered to be limiting in any respect.

Referring now to FIG. 1, there is shown an exploded view of an embodiment of the device for covering a stove top. The device for covering a stove top comprises a frame 11. The frame 11 defines an upper side that is definite oppositely a lower side. The frame 11 is defined by a first pair of opposing members 14 and a second pair of opposing members 13. In the illustrated embodiment, the first pair of opposing members 14 are of a shorter length than the second pair of opposing members 13. As such, the frame 11 is rectangular in shape. When the frame 11 is rectangular in shape, the device for covering a stove top is able to cover a pair of burners that are disposed on the stove top. In one embodiment, the frame 11 is made of a fire-resistant material, such that if the frame 11 is exposed to an activated burner or other heat source, the likelihood of a fire is reduced.

A cover 12 is disposed over top of the upper side of the frame 11. An interior cavity 15 is defined when the cover 12 is disposed over top of the frame 11. Access to the interior cavity 15 is provided via the lower side of the frame 11. The cover 12 is made of any suitable material for the contemplated purpose of covering the frame 11 and defining the interior cavity 15 that is of sufficient size to cover a desired number of burners and to resist elements, such as heat, produced therefrom. In one embodiment, the cover 12 is made of a leather material. In another embodiment, the cover 12 is made of a suede material. In yet another embodiment, the cover 12 is made of a vinyl material. In a further embodiment, the cover 12 is made of an opaque material, such that the stove top surface and the burners are not visible through the cover 12. As such, the stove top surface and burners will be hid from the view of any individuals in the area. A benefit of each of these materials exists where the materials are washable, such that the cover 12 can be washed to prevent the accumulation of dust, debris or allergens upon the cover 12. Materials, such as leather and vinyl are non-porous, and as such are ideal for rendering the cover 12 as washable. In a further embodiment, the cover 12 comprises a design or an indicia thereon. As such, an individual can display an image or other visual element on the cover 12.

In one embodiment, the cover 12 is permanently affixed upon the frame 11, such that the cover 12 is sturdy, reducing the risk of unwanted, inconvenient or accidental removal. In another embodiment, the cover 12 is removably securable to the frame 11. When the cover 12 is removably securable to the frame 11, convenience is provided as the cover 12 is washable. In a kitchen setting, bacteria and other contaminants are spread on a regular basis. The risks associated with contamination and cross-contamination are reduced by providing a cover that is washable. In one embodiment, the cover 12 is made of a fire-resistant material, such that if the cover 12 is exposed to an activated burner or other heat source, the likelihood of a fire is reduced. In a further embodiment, the frame 11 and the cover 12 are coated with a fire-resistant coating, such that the risk of fire is reduced.

Figure 2:
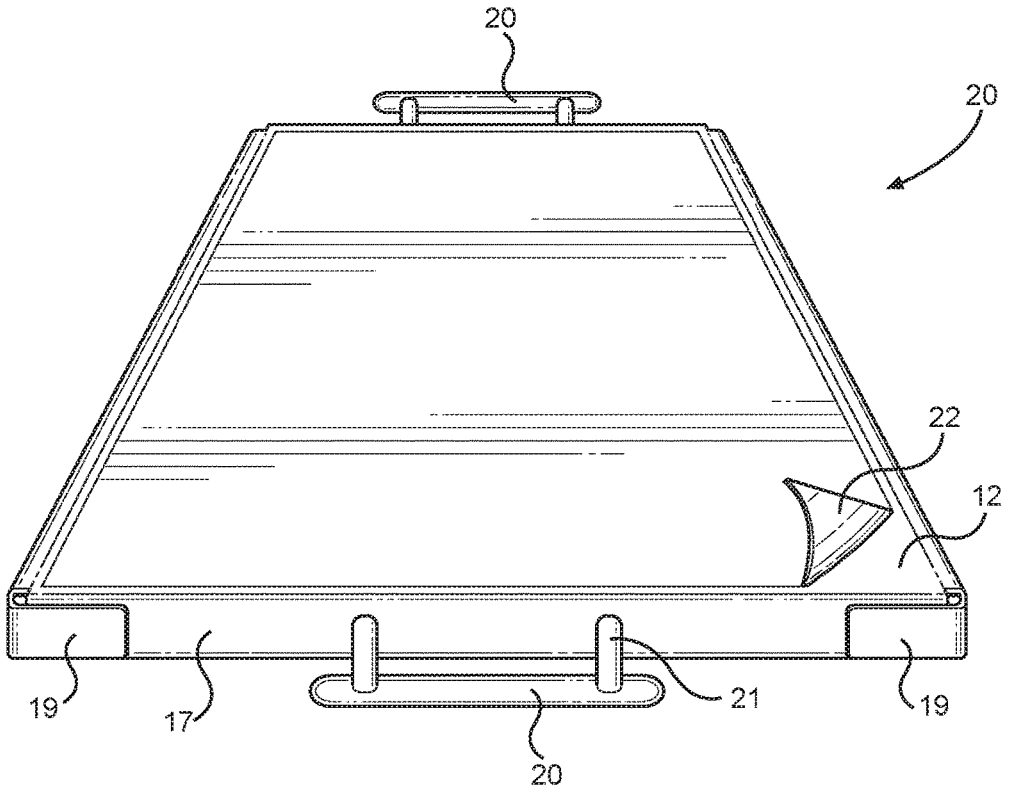
FIG. 2 shows a side perspective view of an embodiment of the device for covering a stove top.

In the illustrated embodiment, the cover 12 defines a first side opposite of a second side. Each of the first side and the second side defines a primary flap 17. The primary flaps 17 are configured to fold downward upon the frame 11, such that the cover 12 is attached to the first pair of opposing members 14 via the pair of primary flaps 17. The cover 12 further comprises a pair of secondary flaps 18 configured to secure to the second pair of opposing members 13. Each secondary flap of the pair of secondary flaps 18 comprises a pair of straps 19 extending from the first side and second side of the cover. The pair of straps 19 are configured to secure to the primary flaps when the cover is in a secured position (as shown in FIG. 2) upon the frame 11. By securing the cover 12 to the frame 11 in such a way, dust and debris is further prevented from entering the interior cavity 15 through any seam defined by the attachment of the cover 12 to the frame 11. In one embodiment, the cover 12 comprises a first material for a central portion of the cover 12 and a second material for at least one of the primary flaps 17, the secondary flaps 18 and the pair of straps 19. As such, different materials having different properties can be utilized. For example, a material having a higher friction coefficient may be utilized on the primary flaps 17 and the secondary flaps 18, such that the device will have greater resistance against sliding. In an alternate embodiment, the cover 12 is configured to cover the entirety of the frame 11.

Referring now to FIG. 2, there is shown a side perspective view of an embodiment of the device for covering a stove top. A handle 20 is disposed on a lateral edge of the frame. The handle 20 is placed to assist a user in moving the frame and cover 12 to and from the targeted location. In the illustrated embodiment, the handle 20 is attached to the cover 12 via a pair of handle supports 21. The handle supports 21 create a gap in which a hand of an individual may be inserted. In one embodiment, the handle 20 is directly integrated upon the cover 12, such that the handle can be washable with the cover 12 due to the risk of contamination of the handle 20 when an individual moves the device for covering a stove top via the handle 20 while working in the kitchen. In the illustrated embodiment, the handle 20 is disposed on a lateral edge of one of the second pair of opposing members. As such, force exerted upon the handle 20 is more efficiently exerted upon the frame.

In alternate embodiments, a plurality of handles 20 are provided. In the illustrated embodiment, a handle 20 is disposed on each opposing member of the second pair of opposing members. As such, an individual may use two arms to pick up and move the device for covering a stove top. This configuration is ideal for situations where the individual is of a diminished physical capacity and would struggle to lift the weight of the device for covering a stove top and for situations where heavy items may be placed on top of the device for covering a stove top.

In a further embodiment, the cover 12 is laminated. As such, the cover is easily and effectively washable. In some embodiment, the cover 12 is entirely laminated. In other embodiments, the cover 12 comprises a laminate layer 22 disposed on a top surface thereof. As such, the top surface, specifically, will be easily washable or rinseable.

Figure 3:
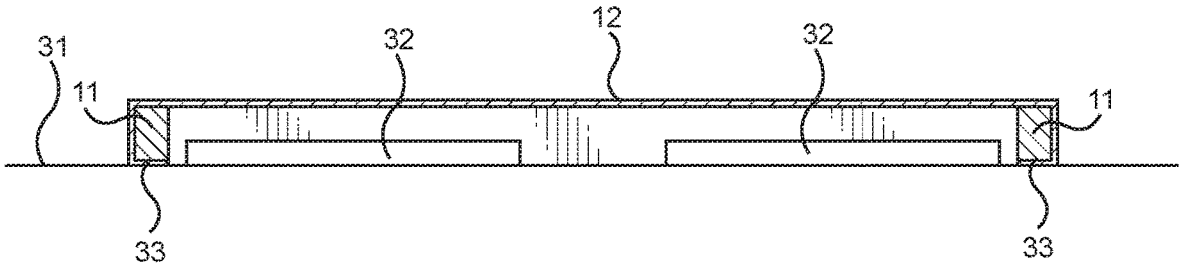
FIG. 3 shows a cross-sectional view of an embodiment of the device for covering a stove top.

Referring now to FIG. 3, there is shown a cross-sectional view of an embodiment of the device for covering a stove top. The frame 11 is configured to rest upon a stove top 31. The interior cavity defined by the frame 11 and the cover 12 is dimensioned to receive a plurality of burners 32 therein. In the illustrated embodiment, the cover 12 extends around the frame 11, such that the cover rests against the stove top 31 when the device for covering a stove top is placed thereon. As such, the cover 12, being made of a material with an increased friction coefficient, will prevent the device for covering a stove top from sliding on the stove top 31. Additionally, in the illustrated embodiment, the cover 12 extends to a bottom surface of the frame 11 such that the non-slip character of the cover 12 is applied directly to the surface of the stove top 31.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A device for covering a stove top, comprising:

a frame, wherein the frame defines an upper side opposite a lower side;

the frame comprising a first pair of opposing members perpendicularly intersecting a second pair of opposing members;

the first pair of opposing members being of a shorter length than the second pair of opposing members;

the frame dimensioned to rest upon a stove top;

a cover removably disposed over the upper side of the frame, such that an interior cavity is defined;

the cover defining a first side and a second side;

each of the first side and the second side having a primary flap;

the cover defining a pair of secondary flaps extending from perpendicular sides of the cover;

each secondary flap defining a pair of straps extending from the first side and the second side of the cover;

the straps of each pair of straps configured to secure to the primary flap, such that the cover is movable into a secured position upon the frame;

the interior cavity accessible via the lower side;

a handle disposed on a lateral edge of the second pair of opposing members.

2. The device for covering a stove top of claim 1, wherein the frame is rectangular.

3. The device for covering a stove top of claim 1, wherein the cover is made of leather.

4. The device for covering a stove top of claim 1, wherein the cover is made of suede.

5. The device for covering a stove top of claim 1, wherein the cover is made of vinyl.

6. The device for covering a stove top of claim 1, wherein the cover is made of an opaque material.

7. The device for covering a stove top of claim 1, wherein the cover is laminated, such that the cover is washable.

8. The device for covering a stove top of claim 1, wherein the cover is made of a fire-resistant material.

9. The device for covering a stove top of claim 1, wherein the frame is made of a fire-resistant material.

10. The device for covering a stove top of claim 1, wherein the frame and the cover are treated with a fire-resistant coating.

* * * * *